United States Patent [19]

Cooper

[11] 4,176,541

[45] Dec. 4, 1979

[54] HAMMER DEVICE ATTACHMENT

[76] Inventor: Tallie B. Cooper, 881 E. 36th Ave., Gary, Ind. 46408

[21] Appl. No.: 915,363

[22] Filed: Jun. 14, 1978

[51] Int. Cl.[2] ..... B21D 37/14

[52] U.S. Cl. ..... 72/474; 29/243.58; 113/57

[58] Field of Search ..... 72/176, 474; 113/54, 113/57; 29/243.5, 243.58

[56] References Cited

U.S. PATENT DOCUMENTS

| | | | |
|---|---|---|---|
| 1,816,318 | 7/1931 | Eksergian | 113/57 |
| 2,609,020 | 7/1952 | Troop | 113/54 X |
| 2,646,100 | 7/1953 | Gibson | 113/54 |
| 3,188,729 | 6/1965 | Poque, Jr. et al. | 43/54 |

*Primary Examiner*—Leon Gilden

*Attorney, Agent, or Firm*—Walter Leuca

[57] ABSTRACT

A hammer device for attachment to a hand power tool for longitudinally folding the overlapping edge of a sheet metal panel. It comprises a body member having a central bore, one end of which is provided with means for connection to a hand tool which powers a reciprocating drive. Connected to the diametral sides of the body member are stud members, the distal ends of which longitudinally extend beyond the other end of the body member and are adapted to support an anvil plate member. The hammer member comprises a longitudinal shaft member having a hammer pad extending radially therefrom. The shaft is reciprocatingly and rotatably movable in the bore of the body member. The drive means of the power tool reciprocatingly drives the hammer pad against the anvil member while the hammer pad is free to pivot back and forth.

5 Claims, 5 Drawing Figures

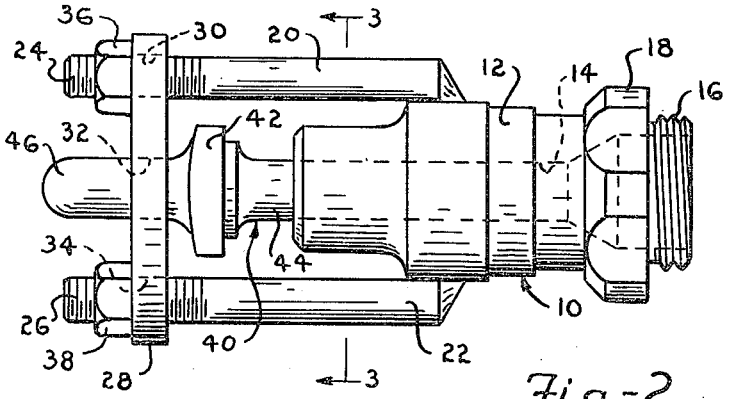
Fig.-2
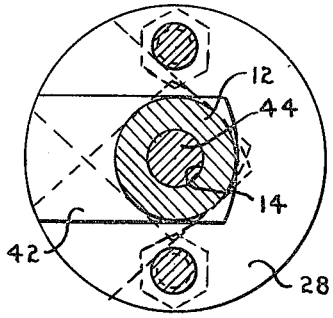
Fig.-3
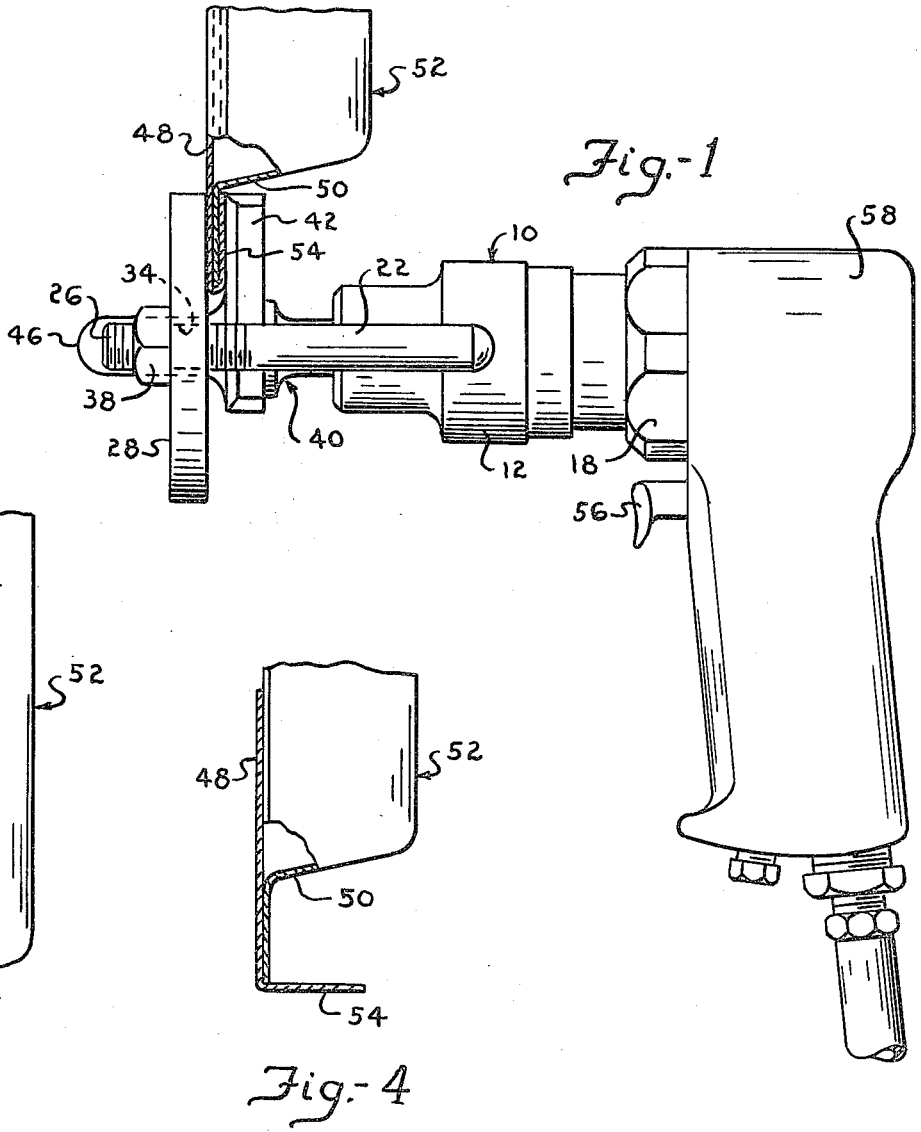
Fig.-1
Fig.-4
Fig.-5

HAMMER DEVICE ATTACHMENT

BACKGROUND OF THE INVENTION

1. Field of the Invention

This invention relates to hammer devices and more particularly to a hammer attachment for a power tool to longitudinally fold the edge of sheet metal.

2. Description of the Prior Art

When an automobile door is damaged, it is removed and dismantled by removing the door panel from the door frame. If the damage is sufficiently severe to affect the frame, the frame may be repaired after which a new panel is connected to the door frame. The panel is secured around the periphery of the door frame by bending, that is, longitudinally folding the edge of the panel that laps over the edge of the frame. This may be accomplished manually by using a hammer and anvil and slowly progressing around the edge of the frame bending and folding the panel edge against the periphery of the frame. This manual operation requires skill and is time consuming making such repairs costly. The tools extant in the prior art for this purpose have reciprocating hammer members of lever members driven to impact against an anvil member for causing the plication. The disadvantage of such prior art tools is that they cannot be readily moved along the edge while the hammer is performing its impacting operation. Each lateral or shifting movement must be accomplished between the blows of a hammer. During the downward stroke of the hammer, the tool must be held stationary during the impacting and release stroke until the hammer is raised clear of the metal edge. Only then may the tool be laterally shifted to its new position and again held stationary for the next impact. Any attempt to laterally shift the tool while the hammer is in its downward or upward motion will bind the tool and may cause a defect in the folding operation. Repositioning the prior art tool for each hammer stroke and holding it stationary during the stroke is very fatiguing to the workman and though the impacting is accomplished automatically by the tool, the progress of the work is slow.

SUMMARY OF THE INVENTION

The hammer device of this invention includes a reciprocating hammer member which reciprocatingly acts against an anvil. It overcomes the objections of the prior art tool by having the hammer member offset from the reciprocating axis and allowing right and left pivotal movement of the offset hammer member. Therefore, the novel feature of this invention allows incremental shifting of the hammer tool during a substantial portion of the impacting and retreating stroke without binding. The worker in handling the tool of this invention is not fatigued because every incremental shift must be poised motionless prior to triggering the hammer stroke but may keep the tool in substantial motion while the impacting operation continues making the movement a back and forth continuous motion without binding and accomplishing the edge folding operation much more rapidly.

Other objects and advantages of my invention will become more apparent after a careful study of the following detailed description taken together with the accompanying drawings which illustrate a preferred embodiment of my invention.

BRIEF DESCRIPTION OF THE DRAWINGS

FIG. 1 is a side elevation of the hammer device of this invention attached to a pneumatic drive tool shown in operative relation for folding the edge of a sheet metal panel to a door frame which is shown in fragment;

FIG. 2 is a front elevation of the hammer device of this invention shown detached from the pneumatic tool;

FIG. 3 is a cross sectional view taken along lines 3—3 of FIG. 2;

FIG. 4 is a cross sectional fragment of the vehicle door frame showing a panel member bent relative to the door frame periphery preparatory to the edge folding operation; and FIG. 5 is a view similar to FIG. 4 showing the edge of the panel being progressively folded over the door frame.

DESCRIPTION OF THE PREFERRED EMBODIMENT

Referring now more particularly to the drawings, numeral 10 designates generally the preferred embodiment of the hammer device of my invention. It comprises a body member 12 having a central bore 14 extending longitudinally therethrough. The end of body member 12 is threaded as at 16 and at the base thereof is provided polygonal collar 18 which serves as a tightening nut. Connected to body member 12 and longitudinally extensive thereof at diametrally opposed sides are anvil support studs 20 and 22. Studs 20 and 22 are provided with threads 24 and 26 respectively, at the distal ends thereof. Anvil plate 28 illustrated as having a circular shape is provided with diametrally aligned holes 30, 32 and 34. Anvil plate 28 is supported on studs 20 and 22 through holes 30 and 34. Nuts 36 and 38 threadedly engage the threaded ends of studs 20 and 22 respectively, to position and fix anvil plate 28 thereon. Hammer member 40 comprises hammer pad 42 which extends radially from reciprocating shaft member 44. Shaft 44 is received in bore 14 of body member 12. The distal end 46 of shaft 44 extends longitudinally of hammer pad 42 and passes through center hole 32 in anvil plate 28 and serves as a guide stem. Center hole 32 serves to guide and maintain shaft 44 in its axial movement to prevent binding and excessive wear during the reciprocating movement of the shaft.

In the operation of this invention, the sheet metal door panel 48 is layed over the frame 50 of door 52 so that edge 54 of the panel extends over the frame edge to form a folding edge or flange. The folding edge 54 is manually bent over the door frame edge to provide a starting point as shown in FIGS. 4 and 5. The hammer device 10 of this invention having been screw connected to the pneumatic drive tool 58 as shown in FIG. 1 is placed against panel edge 54 at the starting point so that the edge of the panel rests on the anvil plate 28 and the hammer pad 42 rests on the bent edge 54 of panel 48. Nuts 36 and 38 are turned on the threaded ends 24, 26 of support studs 20 and 22 to adjustably position anvil plate 28 relative to the hammer shaft 44 and also properly spaced from the hammer pad 42 so that the bent panel edge 54 fits therebetween. Hammering impacts are initiated by depressing trigger 56 of pneumatic tool 58 which completes the folding operation of the door panel 48 to the door frame 50 as shown in FIG. 1 and the tool of my invention may be laterally shifted without regard to the actual position of the hammer pad 42 since at any time before or after the hammer pad reaches the end of its impact stroke the tool may be shifted to its new position as a continuous operation since the hammer pad 42 will pivot in either direction and not bind against the flange edge 54 of panel 48. It is obvious that the shape of the hammer pad may be varied or modified to suit the workpiece to be worked on as well as the anvil shape, for example the hammer pad 42 may be circular in shape or shaped as an angular sector.

I claim:

1. A hammer attachment for a reciprocating drive means to fold sheet metal edges, comprising:

a body member having a longitudinal bore centrally therethrough, one end of said body member having means for connection to said reciprocating drive means;

support means connected to each side of said body member extending longitudinally from the other end of said body members;

an anvil means connected to said support means, said anvil means having a bore in alignment with said bore of said body member; and a hammer member, said hammer member having a longitudinal shaft and an impacting pad extending radially from said shaft intermediate the ends thereof, said pad being pivotally movable between said support means, said one end of said longitudinal shaft being reciprocatingly movable in said bore of said body member and the other end of said shaft being reciprocatingly movable in said bore of said anvil means.

2. The hammer attachment of claim 1 wherein said support means is further characterized as stud members connected to each side of said body member spaced diametrally apart.

3. The tool attachment of claim 2 wherein said anvil member is further characterized as having said bore and spaced holes for receiving the distal ends of said stud members in diametral alignment.

4. The tool attachment of claim 3 wherein said stud members are further characterized as having threaded means on said distal ends of said stud members for supporting said anvil means at adjustable positions.

5. The hammer attachment of claim 2 wherein said impacting pad is further characterized as pivotally abutting against said stud members.

* * * * *